United States Patent [19]

Kokubo et al.

[11] 4,215,811

[45] Aug. 5, 1980

[54] DUST COLLECTOR IN A NOTE COUNTING MACHINE

[75] Inventors: Eiichi Kokubo; Tuyoshi Miyagawa; Minoru Yoshida, all of Tokyo, Japan

[73] Assignee: Laurel Bank Machine Co., Ltd., Tokyo, Japan

[21] Appl. No.: 965,321

[22] Filed: Dec. 1, 1978

[51] Int. Cl.[2] ..... B61L 1/16; G06M 7/00

[52] U.S. Cl. ..... 235/98 R

[58] Field of Search ..... 235/98 R; 55/374, 378, 55/507; 210/460, 463, 510, 454

[56] References Cited

U.S. PATENT DOCUMENTS

| | | | |
|---|---|---|---|
| 217,906 | 7/1879 | Shaler | 210/460 |
| 2,413,954 | 1/1947 | Conterman | 210/454 |
| 2,912,242 | 11/1959 | Richardson | 235/98 R |
| 3,753,500 | 8/1973 | Voegeli | 210/510 |

*Primary Examiner*—Frank Sever

*Attorney, Agent, or Firm*—Fleit & Jacobson

[57] ABSTRACT

There is provided a note counting machine wherein a counter is provided on the top side of the machine body for counting notes one at a time which comprises, a machine body, a counter on the top side of the machine body for counting notes one at a time a dust collector provided within the machine body, an openable upper cover mounted therewithin with a case member and pivotably mounted on the top side of the machine body so that when the upper cover is closed, the case member is engaged with the dust collector in alignment therewith to cause dust attached to the note to be transferred from the notes to the dust collector through the case member.

2 Claims, 4 Drawing Figures

DUST COLLECTOR IN A NOTE COUNTING MACHINE

BACKGROUND OF THE INVENTION

The present invention relates to a dust collector in a note counting machine.

In conventional note counting machines, the upper cover is constructed to be rigidly attached to the upper portion of the machine body. Therefore, when machine trouble occurs, when dust accumulated in a filter provided within a dust collector is discharged or when the filter must be replaced with a new one, the upper cover must be removed by removing fixing means such as bolts and this results in considerable time consumptions and great labor.

SUMMARY OF THE INVENTION

The present invention provides a dust collector of a simple structure, which is attached to a note counting machine comprising a machine body, a counter attached to the top side of the machine body to count the number of notes introduced therein and an upper cover attached to the upper portion of the machine body in a freely openable and closable manner and in which the dust collecting operation can be performed at a high efficiency under dust-free conditions, and in which troubles in a dust-collecting device can be prevented by provision of a filter that can be exchanged or cleaned very easily.

BRIEF DESCRIPTION OF THE DRAWINGS:

The invention will now be described with reference to the accompanying drawings in which.

Figure 1:
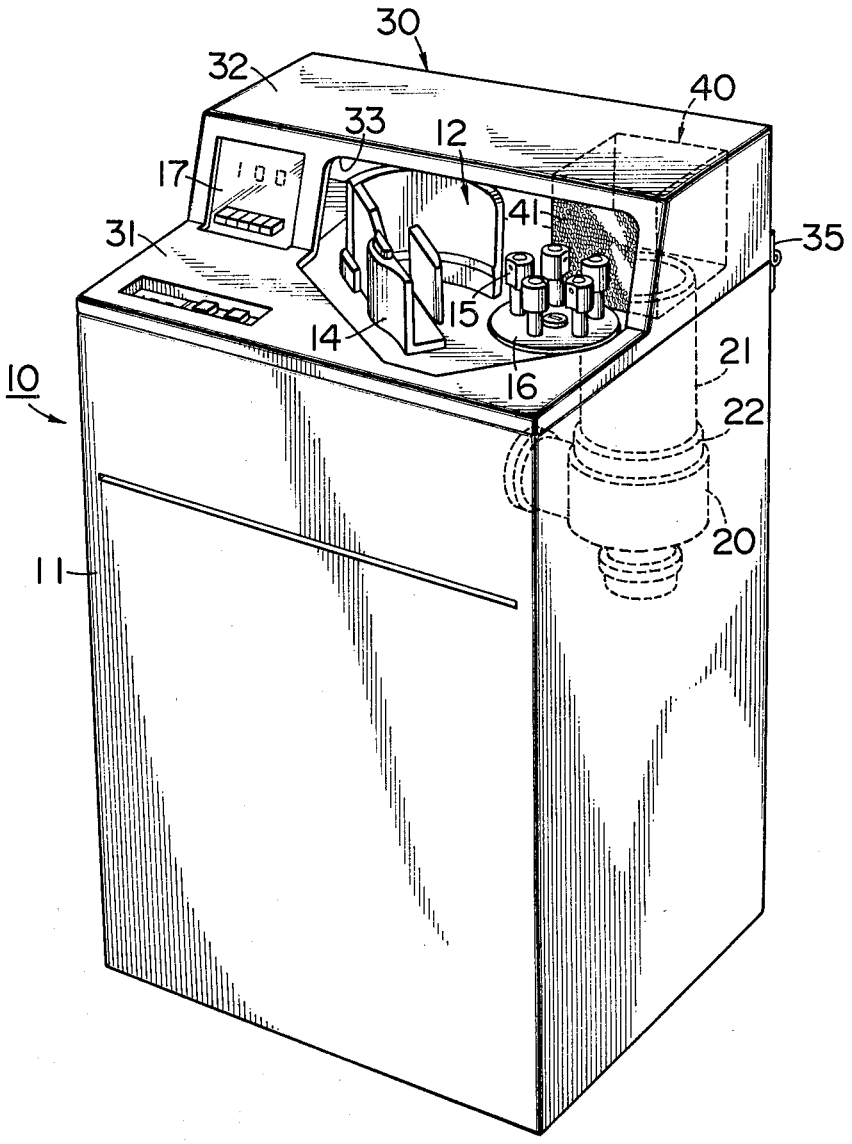
FIG. 1 is a perspective view showing the entire structure of the note counting machine.

DETAILED DESCRIPTION OF THE PREFERRED EMBODIMENTS OF THE INVENTION:

FIG. 1 is a perspective view illustrating the entire structure of a note counting machine 10 to which the dust collector of the present invention is attached. Referring to FIG. 1, a counter 12 is mounted on the top side of a box-shaped machine body 11 and has a known conventional structure including a holder 14 rotatably attached so as to introduce notes, and a plurality of suction shafts 15 located alongside the holder 14 and attached to a rotary cylinder 16 to suck and count notes held therein one at a time. A display device 17 or the like is disposed alongside the counter 12.

A blower type dust-collecting device 20 is installed within the machine body 11, and a cylindrical connection duct 21 is connected to the upper portion on the intake side of the dust-collecting device 20 through a vibration absorbing rubber 22. Duct 21 extends upwardly and an inlet portion 23 on the top end thereof is exposed to the top side of the machine body 11. A flange 24 is formed on the periphery of the inlet portion 23, namely the top end of the connection duct 21. A bag-shaped filter 26 is inserted in the connection duct 21 from the inlet portion 23, and the periphery of an inlet portion 27 of the bag-shaped filter 26 is fitted about the flange 24 through a packing or the like, and a rubber band 28 attached to the edge of the periphery of the inlet portion 27 is fitted and fixed to the flange 24, whereby the bag-shaped filter 26 is attached.

An upper cover 30 is formed so that it is in alignment with the top side of the machine body 11 and covers said top side from above. The cover 30 has a lower surface 31 in the front portion and an upper surface 32 in the rear portion. The inside of the upper surface 32 is formed to have a case-like shape, and an open portion 33 is formed to extend from the front part of the upper surface 32 to the lower surface 31 so that the above-mentioned counter 12 passes therethrough. The rear portion of the upper cover 30 below the rear part of the upper surface 32 is pivoted on the rear portion of the top side of the machine body 11 through a hinge 35 so that the upper cover 30 is freely opened and closed by pivoting it about the hinge 35 as the axis. A bendable stay 36 is interposed between the side portion of the machine body 11 and the upper cover 30.

A case member 40 is fixed in the interior below the upper surface 32 on one side of the upper cover 30, and a perforated iron sheet or metal net face 41 is laid out on the peripheral surface portion of the case member 40, which portion confronts the counter 12 when the upper cover 30 is closed. A round hole-shaped connection opening 42 formed on the lower surface of the case body 40 can be brought into pressured contact with the periphery of the inlet portion 27 of the bag-shaped filter 26 at the inlet portion 23 of the connection duct 21.

Figure 4:
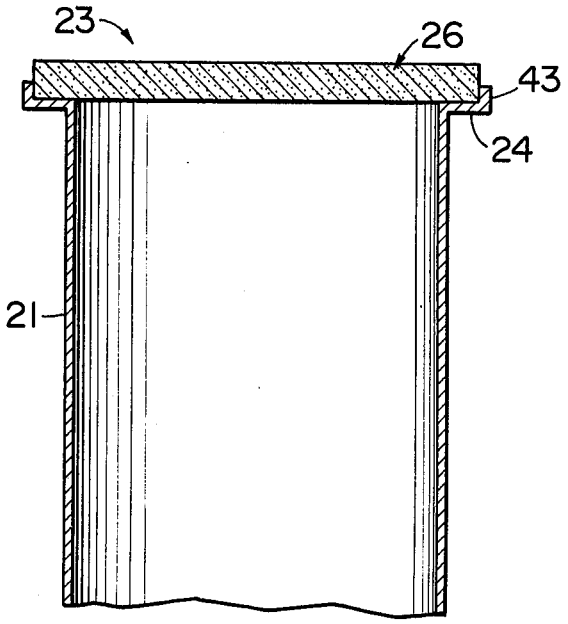
FIG. 4 is a cross-sectional view showing another embodiment of the dust collector.

FIG. 4 illustrates another embodiment of the dust collector. In this embodiment, a rising edge 43 is formed on the outer periphery of a flange 24 at an inlet portion 23 of a connection duct 21 having the same structure as in the above embodiment, and a fairly thick plate-like filter 26 is fitted within the flange 24 and rising edge 43 so that the filter 26 can be detached from the outside. When the upper cover 30 is closed, a connection opening 42 of a case member 40 is pressed against the outer periphery of the plate-like filter 26.

When notes are counted, the upper cover 30 is closed as shown in FIG. 1. In this state, the inlet portion 23 of the connection duct 21 is communicated with the connection opening 42 of the upper cover 30 and in the counter 12 exposed to the outside, stacked notes supported on the holder 14 are sucked turned over and counted one at a time by the suction shafts 15.

Dust is generated during this counting operation. The dust is drawn in by sucking air from the dust-collecting device 20 and is caused to flow into the case body 40 from the metal net face 41 and arrive at the filter 26 through the connection opening 42. The dust is filtered and removed by the filter 26.

In this case, paper fragments formed by breakage of notes are blocked by the metal net face 41 and are not permitted to enter the case body 40.

Figure 2:
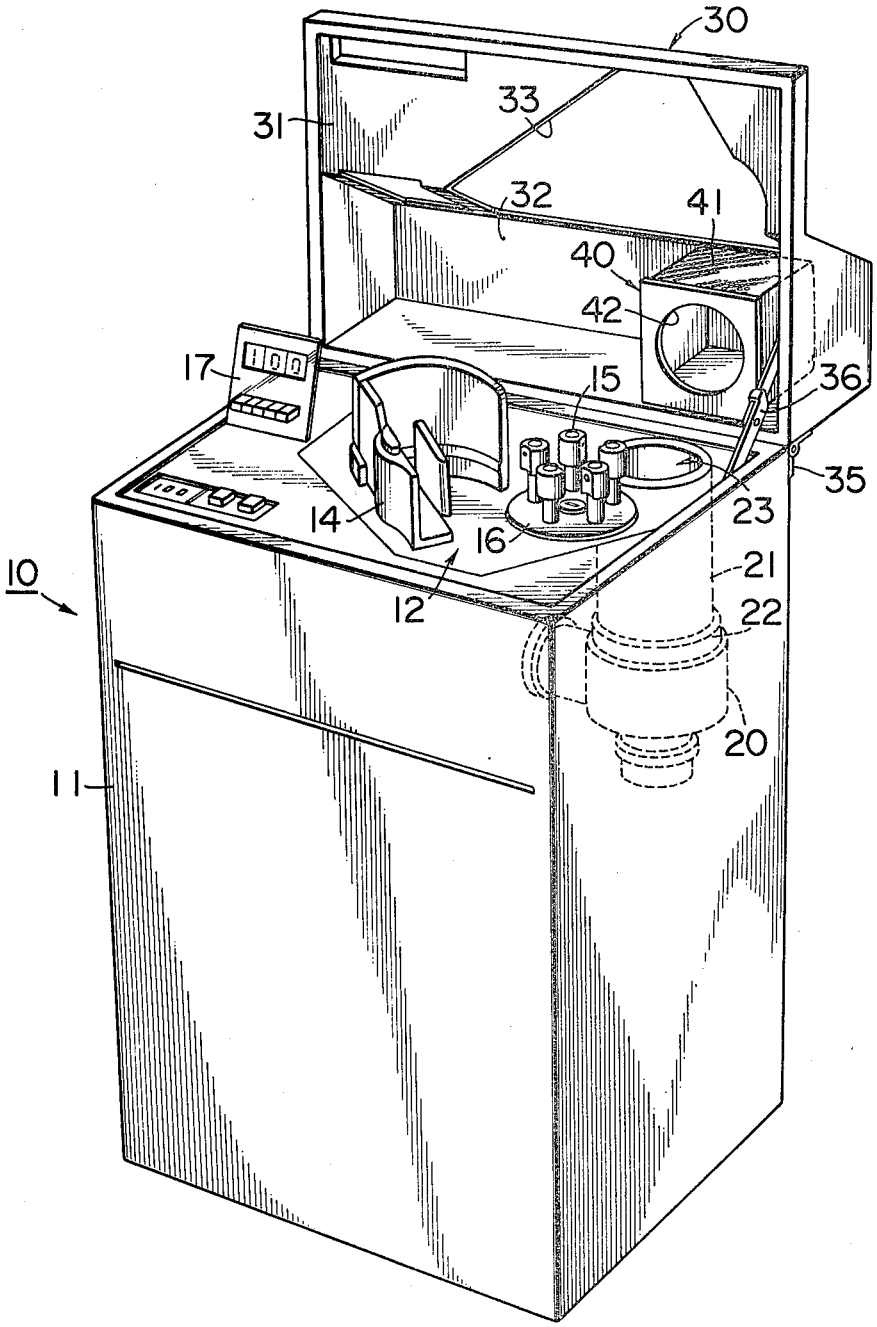
FIG. 2 is a perspective view of the note counting machine with the upper cover opened.
Figure 3:
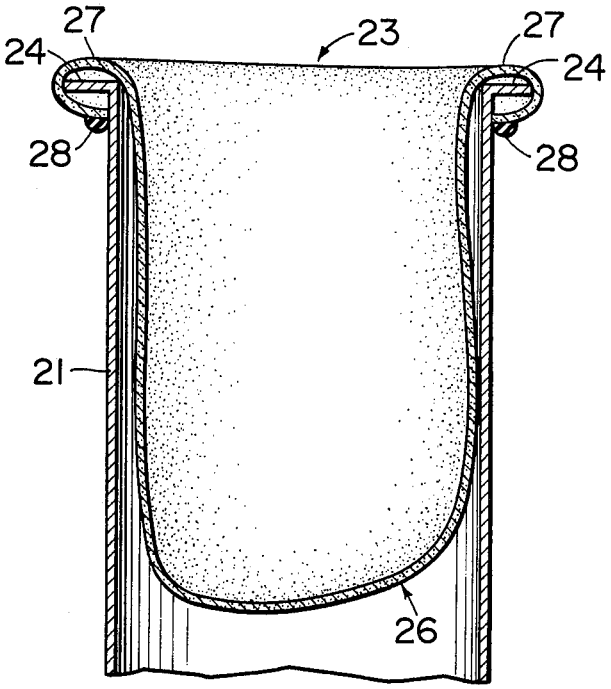
FIG. 3 is a cross-sectional view showing a main portion of a dust collector for use in the note counting machine.

When the filter 26 is cleaned or exchanged, the upper cover 30 is pivoted about the hinge 35 as the center as shown in FIG. 2 and is simultaneously supported by the bendable stay 36. In this state, the rubber band 28 is expanded so that the bag-shaped filter 26 can be upwardly withdrawn and taken out from the interior of the connection duct 21. The filter 26 can be fitted and attached again. In the embodiment shown in FIG. 4, the plate-like filter 26 can be taken out externally and can be fitted and attached again. When the upper cover 30 is closed, the machine is in the state where the counting operation is possible.

When the upper cover 30 has been opened, the interior can be checked and repaired. Since the vibration absorbing rubber 22 is disposed on the dust-collecting device 20, the generation of noise can be prevented.

As will be apparent from the foregoing illustration, the dust collector of the present invention is attached to a note counting apparatus comprising a machine body, a counter attached to the top side of the machine body to count the number of bills introduced therein and an upper cover attached to the upper portion of the machine body in a freely openable and closable manner. The dust collector of the present invention has a structure comprising a dust-collecting device installed within the machine body and having a collection duct inlet portion opened to the top side of the machine body, a filter mounted on the inlet portion dismountably from the outside, and a case member having a metal net surface, which is disposed on the upper cover so that it is exposed to the side of the counter, wherein when the upper cover is closed, the case member is in alignment with the inlet portion. Hence, all paper fragments formed by breakage of notes counted by the counter are blocked by the metal net face, and the dust-collecting operation can be performed at a high efficiency under dust-free conditions. Further, since dust is filtered by the filter disposed inside the machine, troubles in the dust-collecting device can be effectively prevented. When the upper cover is opened, the filter can easily be taken out cleaned or exchanged. In the conventional note counting apparatus of this type, troubles are due mainly to fine paper fragments formed by tearing of notes or dust generated by the counting operation. The above-mentioned structure of the present invention makes it possible to completely prevent such troubles, and when the upper cover is opened, the mechanisms disposed in the interior can be checked and repaired very easily and simply. Thus, according to the present invention, various advantages can be attained by the above-mentioned simple structure.

What is claimed is:

1. In a note counting machine including a machine body, a counter attached to the top side of the machine body for counting bills introduced therein, and an upper cover attached to the upper portion of the machine body for covering the counter, the improvement comprising:

means positioned on one side of said cover for connecting said cover to said machine body so that the side opposite said one side is movable away from said machine body from a first position such that said cover rests on said machine body, to a second position sufficient for providing manual access to the interior of said machine body;

means for providing suction disposed within said interior;

means for filtering, removably disposed within said means for providing suction; and suction port means disposed in said cover adjacent to said counter, said suction port means being positioned and dimensioned to be in substantially sealed fluid communication with said means for providing suction, when said cover is disposed in said first position.

2. The improvement of claim 1, wherein said means for filtering is disposed within an upper portion of said means for providing suction so that said means for filtering is removable when said cover is in the second position.

* * * * *